United States Patent [19]

Syrenne

[11] Patent Number: 4,937,892

[45] Date of Patent: Jul. 3, 1990

[54] DISINFECTING UNIT FOR PRESSURE TYPE FLUSH VALVES AND URINALS

[76] Inventor: Marius H. Syrenne, 1604-9th Avenue N., Saskatoon, Saskatchewan, Canada, S7K 3A1

[21] Appl. No.: 336,690

[22] Filed: Apr. 12, 1989

[51] Int. Cl.[5] ..... E03D 9/02

[52] U.S. Cl. ..... 4/226; 4/222; 4/224

[58] Field of Search ..... 4/222, 222.1, 223, 224, 4/309, 226, 225, 228; 251/40; 220/87; 422/263, 275, 276, 283

[56] References Cited

U.S. PATENT DOCUMENTS

| | | | |
|---|---|---|---|
| 2,148,968 | 2/1939 | Shanley | 251/40 |
| 2,303,913 | 12/1942 | Collinge et al. | 4/224 |
| 2,397,677 | 4/1946 | MacGlashan | 4/224 |
| 2,479,842 | 8/1949 | Kirwan | 4/224 |
| 3,089,508 | 5/1963 | Schulze et al. | 4/228 |
| 3,118,462 | 1/1964 | Pannutti | 4/224 |
| 3,911,507 | 10/1975 | Johnson | 4/224 |
| 4,202,525 | 5/1980 | Govaer et al. | 251/40 |
| 4,229,410 | 10/1980 | Kosti | 4/224 |

FOREIGN PATENT DOCUMENTS

| | | | |
|---|---|---|---|
| 658242 | 2/1963 | Canada . | |
| 9206 | of 1892 | United Kingdom | 4/225 |

*Primary Examiner*—Henry J. Recla
*Assistant Examiner*—Keith Kupfeschmid
*Attorney, Agent, or Firm*—Irell & Manella

[57] ABSTRACT

The cover or cap of a conventional pressure type flush valve is removed and a container is screwed onto the flush valve whereupon the cover or cap is then screwed onto the upper end of the container. A fine screen at the base of the container retains a granular or power type disinfectant, preferably in a bag, and a small tube is secured to the by-pass valve of the flush valve diaphragm and extends upwardly through the screen to adjacent the upper end of the container. The existing adjusting screw is removed and a longer screw screw-threadably engages the cover and extends downwardly through the container to control the action of the valve diaphragm. Each time the valve is actuated, the container evacuates carrying with it dissolved disinfectant which mixes with the water under pressure passing into the toilet or urinal.

18 Claims, 2 Drawing Sheets

DISINFECTING UNIT FOR PRESSURE TYPE FLUSH VALVES AND URINALS

This invention relates to new and useful improvements in pressure flush valve systems or units normally used in toilets and more particularly in urinals.

There are several disadvantages inherent with the use of conventional units, some of which include the poor adjustment in many instances in an attempt to cut down on water usage. Unfortunately, this shortens the flush cycle and in many instances, particularly with urinals, odors and/or bad staining often occurs in the bowls of urinals. The next user therefore often flushes once or twice before using the urinal as well as afterwards so that the end result often includes excess use of water rather than a saving of water.

Other disadvantages are difficulties due to siphoning after pressure interruption has occurred and clogging of the by-pass valve due to scale, solid particles in water, and the relatively fine aperture required under normal conditions.

The first disadvantage, namely, siphoning, may be overcome by the provision of an anti-siphoning by-pass valve but this of course is relatively expensive and includes a ball valve which once again, can be rendered inoperative due to particulate matter.

The present invention overcomes these disadvantages by providing firstly a disinfectant which is flushed into the urinal or toilet bowl every time the device is actuated and secondly a relatively simple anti-siphoning device which takes the place of a relatively expensive anti-siphoning by-pass valve.

Furthermore, because of the slightly more water required to dissolve the disinfectant between flushing actions, a slightly larger aperture or bore is required in the by-pass valve which reduces considerably, servicing which may be required due to particulate blocking of conventional by-pass valves or anti-siphoning valves.

Prior art known to applicant is as follows:

U.S. Pat. No. 2,303,913 issued Dec. 1, 1942, L. C. Collinge et al. This discloses a dispenser for disinfectants whereby a measured quantity of disinfectant liquid is automatically deposited into the trap of a toilet bowl during each flushing operation.

U.S. Pat. No. 2,397,677 issued Apr. 2, 1946, L. J. MacGlashan. This also shows a liquid feeding device for a toilet controlled through the agency of the static pressure existing in a supply duct or pipe.

U.S. Pat. No. 2,479,842 issued Aug. 23, 1949, J. D. Kirwan. This shows a means for sterilizing a flush type toilet bowl by delivering a charge of disinfectant into the toilet bowl subsequent to the flushing thereof.

U.S. Pat. No. 3,118,462 issued Jan. 21, 1964, A. D. Pannutti. This discloses a pressure metering dispenser which operates upon predetermined variations of pressure in a flow pipe.

U.S. Pat. No. 3,911,507 issued Oct. 14, 1975, L. L. Johnson. This shows a water soluble detergent mounted in line with a water line leading from a riser tube to an overflow tube in a reservoir tank of a toilet.

U.S. Pat. No. 4,229,410 issued Oct. 21, 1980, Carl M. Kosti. This shows a disinfectant liquid contained within a water soluble rosinous article which is made functional by merely contacting it with water to release a predetermined amount of the active agents in a gravity fed tank for a toilet.

In accordance with the invention there is provided a disinfecting unit for pressure type flush valves of toilets and urinals in which said flush valve includes a hollow body having an inlet connectable to a source of water under pressure, an outlet connectable to the toilet or urinal and a valve assembly within said body for selectively connecting and disconnecting said inlet with said outlet, said valve assembly including a flexible diaphragm spanning said body between said inlet and outlet and having a by-pass valve therein and a detachable cover assembly on said valve body; said disinfectant unit comprising in combination a disinfectant carrying container detachably secured to the valve body above said diaphragm after the cover assembly is removed, a screen spanning said container adjacent the base thereof and a relatively small bore tube operatively extending from the by-pass valve in the diaphragm, through said screen to adjacent the upper end of said container, a cover for said container, nd a regulating screw screw-threadably engaging said cover and extending through said container to adjacent said valve assembly for controlling the flushing action of said flush valve.

Another aspect of the invention is to provide a kit for use with a pressure type flush valve for toilets and urinals in which said flush valve includes a body, a water inlet and a water outlet in said body and a diaphragm type valve assembly spanning said body for connecting and disconnecting said inlet with said outlet, said valve assembly including a flexible diaphragm spanning said body between said inlet and outlet and having a by-pass valve therein, and a screw threaded cover for said body; said kit comprising a disinfectant carrying container for screw-threadably engaging said valve body in sealing relationship, in place of said cover, said cover screw-threadably engaged in the upper end of said container in sealing relationship, a relatively fine screen spanning said container adjacent the base thereof and a relatively small bore tube securable to said bypass valve and being extendible towards the upper end of said container through said screen, and a regulating screw screw-threadably engaging said cover and extending through said container to adjacent said valve assembly for controlling the flushing action of said flush valve.

Another advantage of the invention is that the device may readily be installed in existing pressure flush valves merely by removing the screw-threaded cover or cap of the flush valve, replacing it with a canister containing the necessary disinfectant and then replacing the cap or cover on the upper end of the canister after securing a relatively small bore tube to the upper side of the by-pass valve which extends upwardly into the cap on the upper end of the canister. The relatively short adjusting screw within the cap is replaced by a longer screw which extends downwardly through the container adjacent the conventional auxiliary valve of the pressure valve assembly.

A still further advantage of the invention is to provide a device of the character herewithin described which is simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figures 1, 3:
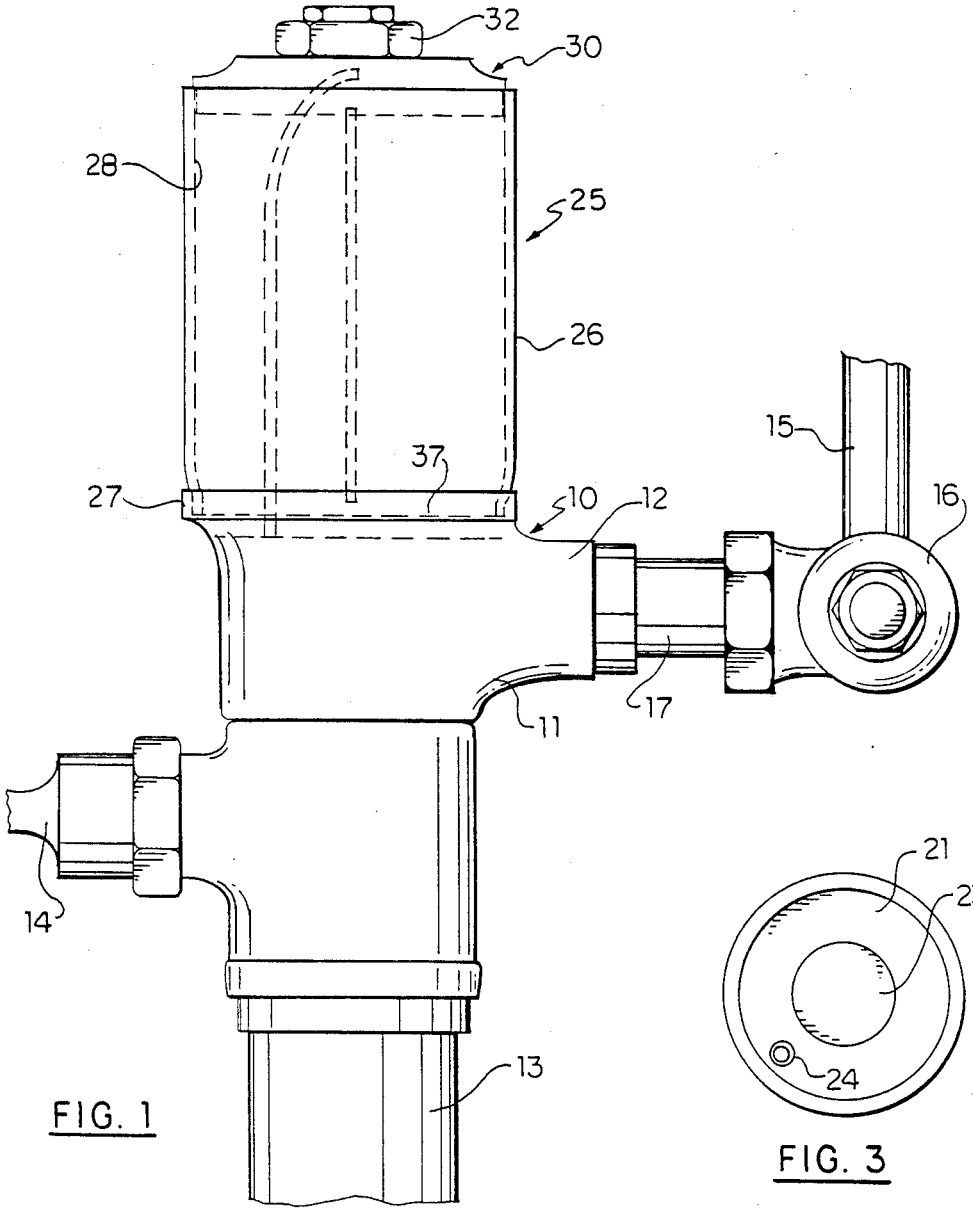
FIG. 1 is a side elevation of a pressure type flush valve with the invention installed thereon.
FIG. 3 is a top plan view of the valve assembly.

Proceeding therefore to describe the invention is detail, reference should first be made to FIG. 1 in which 10 illustrates generally, a conventional pressure type flush valve assembly 10 including a valve body 11, an inlet 12 for the introduction of water under pressure, an outlet 13 normally connectable to the urinal or toilet and an actuating handle 14.

Water under pressure enters the valve body via a conduit 15 through a pressure and volume adjusting component 16 and nipple 17 all of which is conventional.

Figure 2:
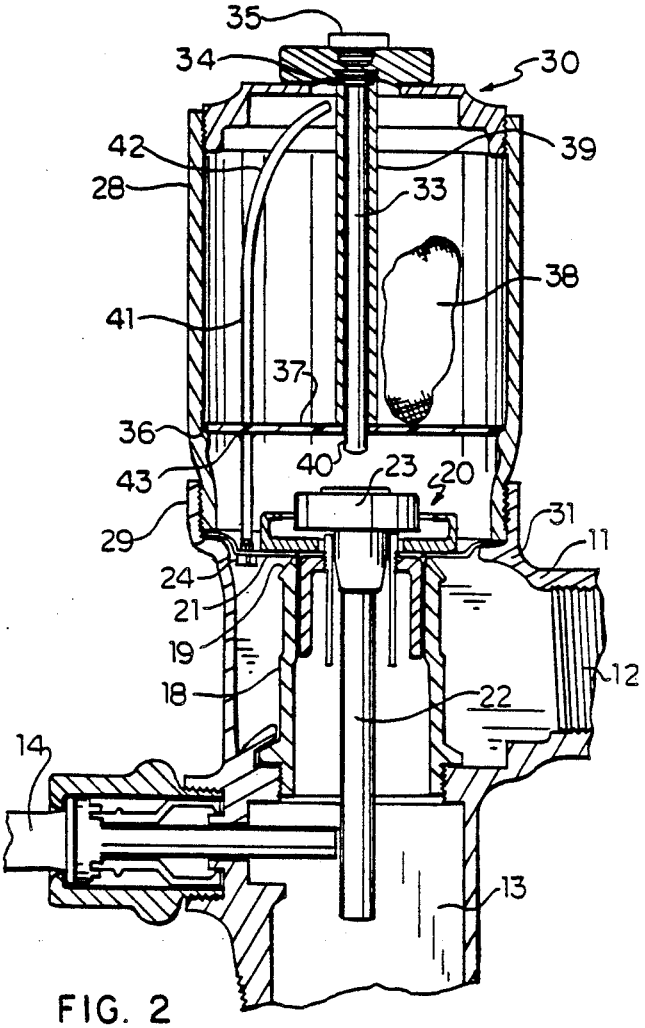
FIG. 2 is a vertical cross-section of FIG. 1 with the conventional portions of the interior of the pressure valve assembly shown schematically.
Figure 2A:
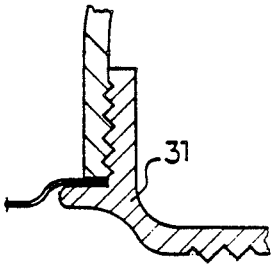
FIG. 2A is a fragmentary enlarged view of one side of FIG. 2 showing the engagement of the canister with the diaphragm in the valve body.
Figure 4:
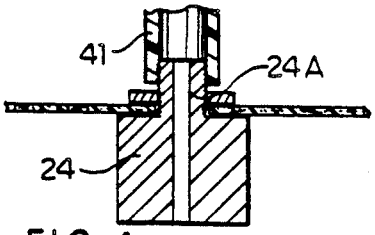
FIG. 4 is an enlarged cross-sectional view of a conventional by-pass valve assembly.
Figure 5:
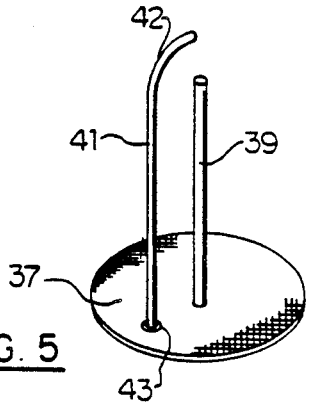
FIG. 5 is an isometric view of the screen with the protective sleeve and anti-siphon tube shown thereon.

FIG. 2 shows, schematically, the interior of the valve body 11 which includes a cylindrical valve conduit 18 extending upwardly and having a valve seat 19 on the upper end thereof upon which the main valve assembly, collectively designated 20, engages. This main valve assembly includes a flexible diaphragm 21 preferably made of leather, spanning the valve body as normally engaging the seat 19 of the valve portion 18 and, in effect, controlling the flow of water from the inlet 12 to the outlet 13. A control stem 22 is operatively contacted by the control handle 14 which, when actuated, raises an auxiliary valve head 23 from the diaphragm 21 thus releasing the water under pressure above the diaphragm, downwardly through the valve seat portion 18 and to the outlet 13. This allows the pressure of the water below the diaphragm and from the inlet 12, to raise the main diaphragm clear of the valve seat 19 and water under pressure then flows directly from the inlet 12 to the outlet 13 and the flushing action commences.

A by-pass valve 24 extends through the diaphragm and while the flushing action is taking place, the excess pressure of the water gradually fills the portion of the valve body above the diaphragm until the pressure equalizes at which time, the diaphragm descends closing off the valve seat 19 and the device is then ready for the next flushing action which is initiated by actuation of the handle 14.

The invention collectively designated 25 consists of a canister or container 26 which is generally cylindrical in configuration and which is provided with an external screw threaded base 27 and an internal screw threaded upper end 28.

The lower end 27 of the container is adapted to screw-threadably engage within the upper end 29 of the valve body 11 after the cap or cover 30 has been removed therefrom and this cap or cover 30 is in turn adapted to screw-threadably engage within the upper end 28 of the container 26.

In the original construction of the pressure type valve assembly, the lower edge of the cap or cover engages the periphery of the flexible diaphragm 21 and clamps it between the lower edge and a ledge 31 at the base of the screw threads in the upper end 29 of the valve body. When the container 26 is screw-threadably engaged within the valve body instead of the cap or cover 30, the lower end of the container also clamps the periphery of the flexible diaphragm 21 against the aforementioned ledge 31, it being understood that sealing relationship is retained both between the base of the container and the upper end of the valve body and between the cap or cover 30 and the upper end 28 of the container 26.

One modification is made to the cap 30, namely, the conventional adjusting screw which screw-threadably engages downwardly through the centre bore 32 of the cap is replaced with a relatively long adjusting screw 33 also screw-threadably engagable within the bore 34 in the centre of the cap with the conventional cover screw 35 being replaced after the necessary adjustment has been made.

An annular ledge or the like 36 is formed around the interior of the container 26 just above the lower end 27 thereof and retains a relatively fine screen 37 which spans the container and a porous bag 38 of disinfectant crystals or other water soluble solids, may rest upon this screen, it being understood that the contents of the bag are soluble in water and may permeate through the bag into the container 26.

Alternatively, soluble disinfectant material in cake form may be placed directly upon the screen if desired but containing same within a bag such as bag 38 reduces the possibility of solid materials passing downwardly through the screen prior to dissolving in the water. It will be appreciated that the material above the screen may be a disinfectant, deodorant, bacteriacide or a combination thereof.

A cylindrical sleeve 39 is secured centrally of the screen and extends upwardly therefrom to engage around the bore 34 and prevents water containing disinfectant from attacking and perhaps corroding the adjusting screw 33 and also prevents leakage past the central aperture 40 in the screen 37 through which the adjusting screw 33 passes. It also prevents the bag or cake from interfering with the action of the diaphragm or of the adjusting screw.

A relatively fine bore tube 41 is secured as by soldering or welding or other means, around the upper end of the by-pass valve 24 and extends upwardly through the container with the upper end 42 resting against the inside of the cap or cover 30. It also passes through screen 37 and is welded or soldered thereto as indicated by reference character 43. This prevents siphoning from occurring in the event that pressure in the system is lost as it extends nearly to or above the water level as there is always an air space at the upper end of the cap due to the sealed relationship thereof to the container.

In operation, and under normal working conditions, water is present within the container to adjacent the upper end of the cap or cover 30 and is at the same pressure as water below the diaphragm 21, said water entering the inlet 12.

The water within the container dissolves some of the disinfectant which permeates through the screen into the container. When the valve is flushed as hereinbefore described, the auxiliary valve 23 releases the pressure above the diaphragm and this water containing the dissolved disinfectant passes downwardly to the discharge 13 thus enabling the water pressure below the diaphragm to lift same clear of the valve seat 19 so that the main flushing action takes place. At the same time water is passing upwardly through the by-pass valve 24 and through the tube 41 and filling the container above the diaphragm until the pressures equalize and the diaphragm closes. This water is under pressure as it flows through tube 41 thus causing turbulence as it fills the container thus assisting in the dissolving action of the disinfectant.

If pressure fails, only a very little water, if any, will pass downwardly through tube 41 until the upper end 42 is above the water line so that the remaining water, even if the pressure has been lost, maintains the diaphragm in a pliant condition and the apparatus is ready to operate just as soon as pressure is returned to the inlet 12.

The device not only provides disinfectant or the like within the water above the diaphragm which first passes into the toilet bowl or urinal in the flushing action but also eliminates the need for a relatively expensive non-siphoning by-pass valve. Because of the additional volume of water required to fill the container, the bore 24A through the by-pass valve is made slightly larger than conventional thus reducing the possibility of blockage occurring.

The advantages of the invention may be summarized as follows:

(1) If the water pressure fails, water in the valve will not syphon out thereby preventing drying up of the flexible leather diaphragm and also leaving the valve in a position to be automatically wetted as soon as the pressure is returned.

(2) The bore 24A in the by-pass valve is larger than conventional thereby reducing the possibility of blockage occurring by particulate matter in the water.

(3) Odor problems occur in conventional urinals and the like because the operators endeavor to save water as much as possible. This is done by closing the controls of the valves too much which causes the problem of not enough water passing to complete a "full flush".

This means that the bowl of the urinal is not cleaned properly with concomitant faults of bad odor and stains in the bowls. In actual fact, water generally is not saved because the next user tends to flush before and after and ends up by using more water.

The present device corrects this situation with the relatively large hole in the by-pass which reduces the tendency of blockage by particulate matter, and with this system, the urinal is adjusted as follows. With the uppermost adjusting screw 33 opened approximately half way, and water pressure control 16 opened at approximately quarter capacity, the screw 33 limits the opening of the auxiliary valve head 23 so that an ideal flush may be obtained with conventional pressures. It is also more silent.

These settings provide a complete flush so that no residue remains and as the single flush contains the chemical bacteriacide or the like, it in fact uses less water than is conventional.

It is of course essential that the valves are set according to the design parameters and should not be altered unless of course the pressure changes radically. If the control valve 16 is opened too wide, the water will tend to flush over the urinal or bowl trap and if closed too much, the flushing cycle will not be strong enough to complete the flush.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A disinfecting unit adapted to be connected to pressure type flush valves of toilets and urinals in which said flush valve includes a hollow body having an upper end, an inlet connectable to a source of water under pressure, an outlet connectable to the toilet or urinal and a valve assembly within said body for selectively connecting and disconnecting said inlet with said outlet, said valve assembly including a valve seat operatively associated therewith, a flexible diaphragm which spans said body between said inlet and outlet such that the water is released into said outlet when said assembly is lifted off said valve seat and a by-pass valve located in said diaphragm to fill a portion of said body located above the diaphragm with water from said inlet and a detachable cover assembly located on top of said valve body; said disinfectant unit comprising a disinfectant carrying container having a base and an upper and lower end and adapted to be detachably secured to the valve body above said diaphragm after the cover assembly is removed, a screen spanning said container adjacent said container base and a relatively small bore tube adapted to be operatively extended from the by-pass valve in the diaphragm, through said screen to adjacent said container upper end, a cover for said container having an underside and side walls, and an adjusting screw adapted to screw-threadably engage said cover and extend through said container to adjacent said valve assembly for controlling the flushing action of said flush valve.

2. The unit according to claim 1 which includes a protective sleeve extending from said screen to said cover underside, said adjusting screw extending freely through said sleeve thereby preventing granular disinfectant from reaching the diaphragm.

3. The unit according to claim 1 in which said tube extends towards said cover underside and then curves over towards said cover side wall.

4. The unit according to claim 2 in which said tube extends towards said cover underside and then curves over towards said cover sidewall.

5. The unit according to claim 1 in which said container lower end is adapted to screw threadably engages the said valve body upper end in sealing relationship and is adapted to secure the diaphragm in position spanning said valve body, said container upper end is adapted to screw threadably engage said valve body cover whereby said valve cover acts as the container cover.

6. The unit according to claim 5 which includes a protective sleeve extending from said screen to said cover underside, said adjusting screw extending freely through said sleeve thereby preventing granular disinfectant from reaching the diaphragm.

7. The unit according to claim 5 in which said tube extends towards said cover underside and then curves over towards said cover sidewall.

8. The unit according to claim 6 in which said tube extends towards said cover underside and then curves over towards said cover sidewall.

9. A disinfectant unit in combination with a pressure type flush valve for toilets and urinals in which said flush valve includes a hollow body having an upper end, an inlet connectable to a source of water under pressure and an outlet connectable to the associated toilet or urinal, a valve assembly within said body for selectively connecting and disconnecting said inlet with said outlet, said valve assembly including a valve seat operatively associated a flexible diaphragm which spans said body between said inlet and outlet such that the water is released into said outlet when said valve assembly is lifted off said valve seat and a by-pass valve located in said diaphragm to fill a portion of said body located above the diaphragm with water from said inlet, and a detachable cover assembly located on top of said valve body, said disinfectant unit including a disinfectant carrying container having a base and an upper end detachably secured to said valve body above said diaphragm after said cover assembly is removed, a screen spanning the said container adjacent said container base, a relatively small bore tube operatively extending from said by-pass valve in said diaphragm, through said screen to adjacent said container upper end, a cover for said container having an underside and sidewalls, and an adjusting screw screw-threadably engaging said cover and extending downwardly through said container to adjacent said valve assembly for controlling the flushing action of said flush valve.

10. The combination according to claim 9 which includes a protective sleeve extending from said screen to said cover underside, said adjusting screw extending freely through said sleeve thereby preventing granular disinfectant from reaching the diaphragm.

11. The combination according to claim 9 in which said tube extends towards said cover underside and then curves over towards said cover sidewall.

12. The combination according to claim 10 in which said tube extends towards said cover underside and then curves over towards said cover sidewall.

13. The combination according to claim 9 in which said container screw-threadably engages said valve body upper-end in sealing relationship and secures the diaphragm in position spanning said valve body said cover assembly of said valve body screw threadably engaging said container upper end and acting as said cover therefore.

14. The combination according to claim 10 in which said container screw-threadably engages said valve body upper end in sealing relationship and secures the diaphragm in position spanning said valve body, said cover assembly of said valve body screw-threadably engaging said container upper end and acting as said cover therefore.

15. The combination according to claim 11 in which said container screw-threadably engages said valve body upper end in sealing relationship and secures the diaphragm in position spanning said valve body, said cover assembly of said valve body screw-threadably engaging said container upper end and acting as said cover therefore.

16. A kit of parts for use with a pressure type flush valve for toilets and urinals in which said flush valve includes a body, in water inlet and a water outlet in said body and a diaphragm type valve assembly spanning said body for connecting and disconnecting said inlet with said outlet, said valve assembly including a valve seat operatively associated with a flexible diaphragm spanning said body between said inlet and outlet such that the water is released into said outlet when said valve assembly is lifted off said valve seat and having a by-pass valve located in said diaphragm to fill a portion of said body located above the diaphragm with water from said inlet, and a screw-threaded cover having an underside and sidewalls for said body; said kit comprising a disinfectant carrying container having a base and an upper and lower end screw-threadably engaging said valve body in sealing relationship, in place of said cover; said cover screw-threadably engaging in the upper and of said container in sealing relationship, a relatively fine screen spanning said container adjacent the container base thereof and a relatively small bore tube securable to said by-pass valve and being extendable towards the upper end of said container through said screen, and an adjusting screw screw-threadably engaging said cover and extending through said container to adjacent said valve assembly for controlling the flushing action of said flush valve.

17. The kit according to claim 16 which includes a protective sleeve extending from said screen to said cover underside, said adjusting screw extending freely through said sleeve thereby preventing granular disinfectant from reaching the diaphragm.

18. The unit according to claim 16 in which said tube extends towards said cover underside and then curves over towards said cover sidewall.

* * * * *